US008621886B1

(12) United States Patent
Wallace

(10) Patent No.: US 8,621,886 B1
(45) Date of Patent: Jan. 7, 2014

(54) JEWELRY SAFETY DEVICE

(76) Inventor: Terence Wallace, Bronx, NY (US)

( * ) Notice: Subject to any disclaimer, the term of this patent is extended or adjusted under 35 U.S.C. 154(b) by 118 days.

(21) Appl. No.: 13/238,700

(22) Filed: Sep. 21, 2011

(51) Int. Cl.
*A44C 5/02* (2006.01)

(52) U.S. Cl.
USPC ..... 63/4; 63/21; 63/1.18; 224/166

(58) Field of Classification Search
USPC ..... 63/1.18, 21, 23, 3, 3.1, 4; 224/166, 164, 224/168, 177; 59/80, 82; 368/281, 282
See application file for complete search history.

(56) References Cited

U.S. PATENT DOCUMENTS 1,398,803 A * 11/1921 Schneider ..... 24/13
1,482,664 A 2/1924 Smith
2,138,596 A * 11/1938 Fassnacht ..... 63/23
2,484,200 A * 10/1949 Werntz ..... 224/166
2,526,134 A * 10/1950 Henry ..... 63/32
3,877,250 A 4/1975 Musillo
4,315,352 A 2/1982 Wagner
5,335,569 A * 8/1994 Rowley ..... 81/125
2004/0168469 A1 9/2004 Tetu et al.
2011/0232329 A1* 9/2011 Boyd ..... 63/4

* cited by examiner

*Primary Examiner* — Jack W. Lavinder
*Assistant Examiner* — Abigail E Morrell

(57) ABSTRACT

The jewelry safety chain device is a flexible cable which has a first end spaced apart from a second end, a loop disposed on the flexible cable first end, a clasp disposed on the flexible cable second end, a plurality of eye screws, each eye screw having an eyelet, a shaft extended from the eyelet, a point disposed distally on the shaft, a thread disposed on the shaft medially from the point, each eye screw configured to selectively attach to a link of an existing multi-link band of an existing jewelry item, the flexible cable and cable loop configured to attach to one of the eyelets, the flexible cable configured to pass through a remainder of the eyelets and the clasp configured to attach to one of the eyelets, thereby removably securing a chosen pair of links together in preventing inadvertent jewelry item loss.

4 Claims, 3 Drawing Sheets

JEWELRY SAFETY DEVICE

BACKGROUND OF THE INVENTION

The loss of a jewelry item can be expensive as well as heart breaking. Many jewelry items are at least partially comprised of a multi-link band with multiple fastened or fastenable links. This may be true of such items as watches, bracelets, and necklaces, for example. Such items can sometimes come undone and be lost or damaged. Also, such jewelry items can have links fail, even if separate from links adjoined by an existing band clasp. The present device provides for installation onto such jewelry items in order to ensure against inadvertent loss.

FIELD OF THE INVENTION

The jewelry safety chain device relates to jewelry items and more especially to a safety chain device that prevents jewelry item loss even in the event of failure of item links or existing item clasp.

SUMMARY OF THE INVENTION

The general purpose of the jewelry safety chain device, described subsequently in greater detail, is to provide a jewelry safety chain device which has many novel features that result in an improved jewelry safety chain device which is not anticipated, rendered obvious, suggested, or even implied by prior art, either alone or in combination thereof.

To attain this, the jewelry safety chain device provides eye screws that are designed to anchor into links and even each link of a multi-link jewelry item, such as a watch, bracelet, or necklace, for example. Preferably, the eye screws may be comprised of an eyelet on one end with a shaft extended from the eyelet. The shaft is threaded and also has a point. The eye screws are thereby more readily received by the links. The flexible cable of the device is passed through the eye screw at one end of a jewelry item and looped through the flexible cable's loop at the flexible cable first end. The flexible cable is passed through each eyelet of each eye screw. The second end of the flexible cable has a clasp that is hooked onto an eyelet of an eye screw that is typically, for example, attached to a side of a link at either an opposite end of a jewelry item or on an opposite side of a jewelry item, thereby ensuring against the potential loss of the jewelry item. Jewelry items often have securing devices that may be prone to releasing, for example. The device may be used to bridge across the links joined by the existing securing device, often the existing band clasp. The device provides a secondary insurance against jewelry item loss by providing a secondary clasp device.

The device is available in various material makeups that may include stainless steel, gold, silver, platinum, and other appropriate materials that are aesthetically pleasing and that may be chosen to compliment a jewelry item. The device is provided in various sizes in order to be aesthetically pleasant when accompanying a given jewelry item.

The clasp disposed on the flexible cable second end may be comprised of any number of clasp designs, including a spring loaded clasp that resists opening.

Thus has been broadly outlined the more important features of the improved jewelry safety chain device so that the detailed description thereof that follows may be better understood and in order that the present contribution to the art may be better appreciated.

An object of the jewelry safety chain device is to prevent jewelry item loss.

Another object of the jewelry safety chain device is to prevent loss of watches, bracelets, necklaces, and the like.

A further object of the jewelry safety chain device is to be attractive.

An added object of the jewelry safety chain device is to be capable of installation to almost any multi-link band jewelry item.

And, an object of the jewelry safety chain device is to be easily clasped and unclasped.

These together with additional objects, features and advantages of the improved jewelry safety chain device will be readily apparent to those of ordinary skill in the art upon reading the following detailed description of presently preferred, but nonetheless illustrative, embodiments of the improved jewelry safety chain device when taken in conjunction with the accompanying drawings.

DETAILED DESCRIPTION OF THE DRAWINGS

With reference now to the drawings, and in particular FIGS. 1 through 6 thereof, the principles and concepts of the jewelry safety chain device generally designated by the reference number 10 will be described.

Figure 2:
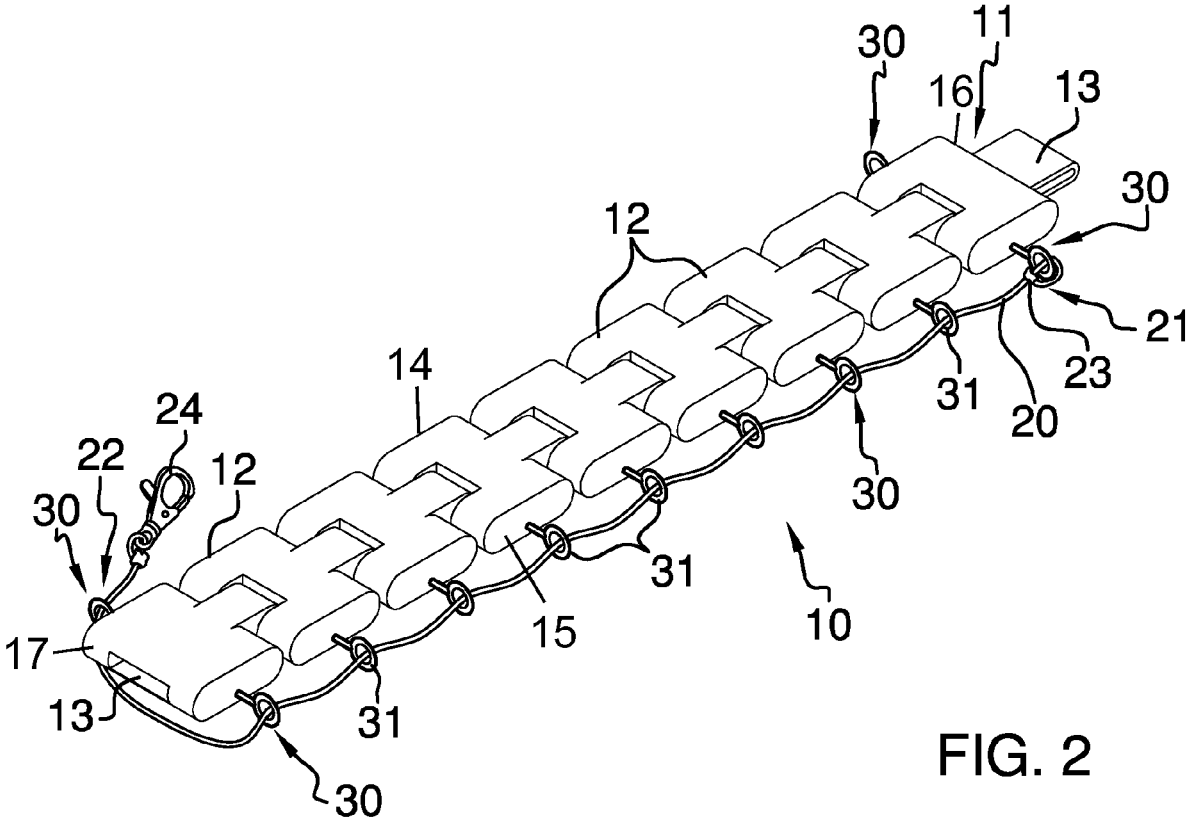
FIG. 2 is a perspective in-use view.

Referring to FIG. 2, the device 10 partially comprises a flexible cable 20 having a first end 21 spaced apart from a second end 22. A loop 23 is disposed on the flexible cable 20 first end 21.

Figure 3:
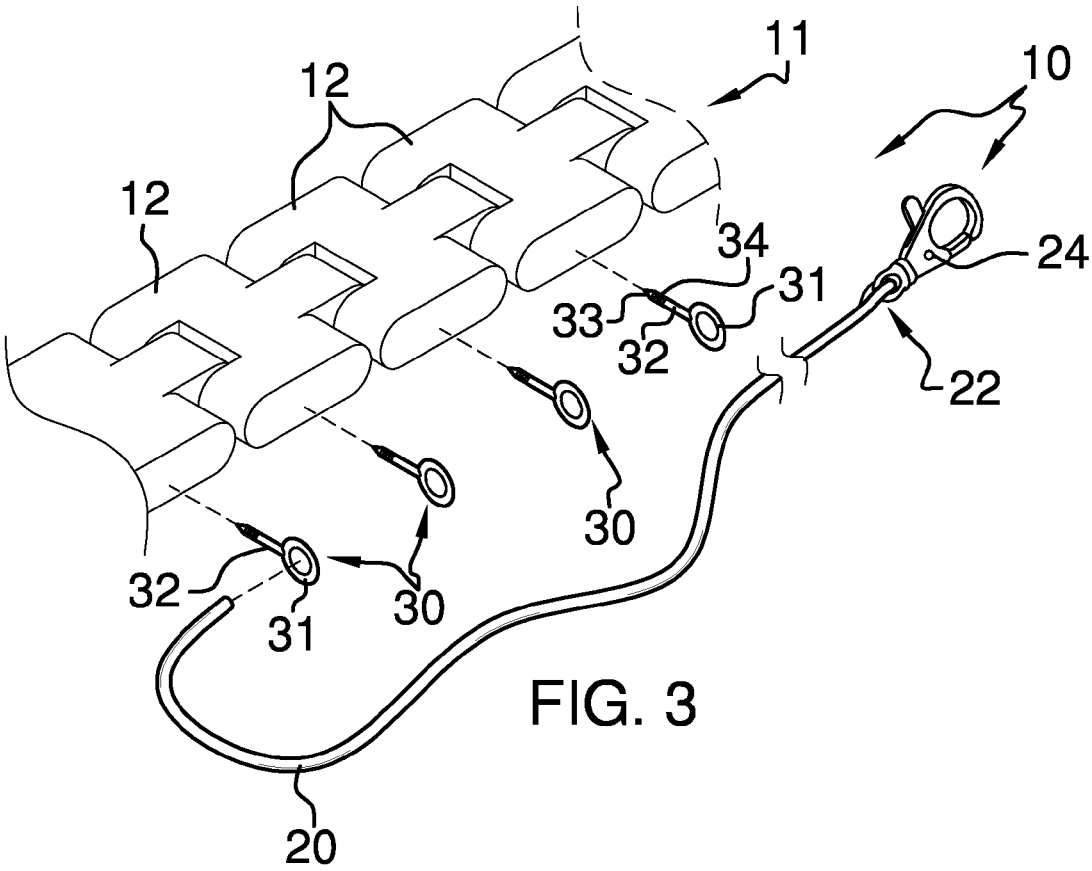
FIG. 3 is a perspective view in preparation of installation onto a multi-link band of jewelry.

Referring to FIG. 3, a spring loaded clasp 24 is disposed on the flexible cable 20 second end 22.

Figure 1:
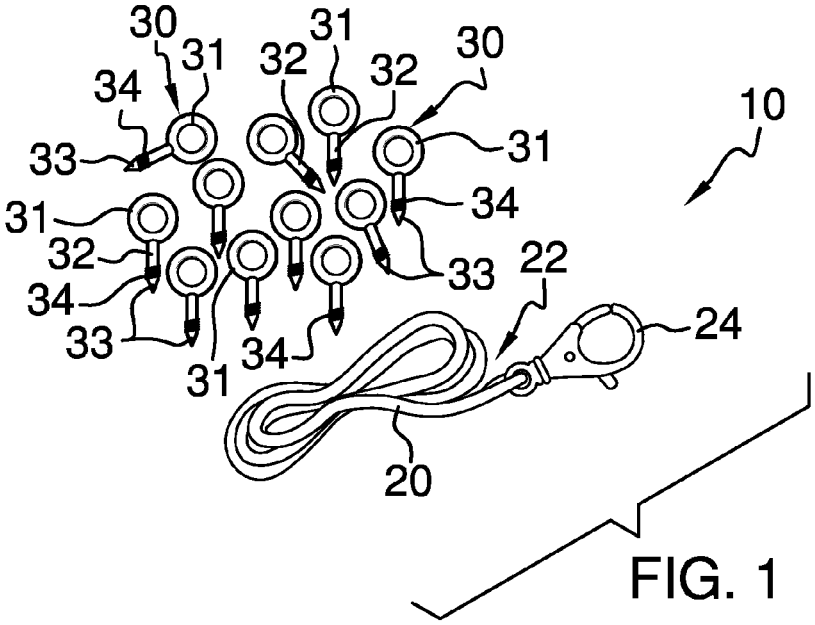
FIG. 1 is a top plan view.

Referring to FIG. 1, a plurality of eye screws 30 is provided. Each eye screw 30 partially comprises an eyelet 31. A shaft 32 is extended from the eyelet 31. A point 33 is disposed distally on the shaft 32. A thread 34 is disposed on the shaft 32 medially from the point 33. The sharpened point 33 aids eye screw 30 insertion.

Figure 4:
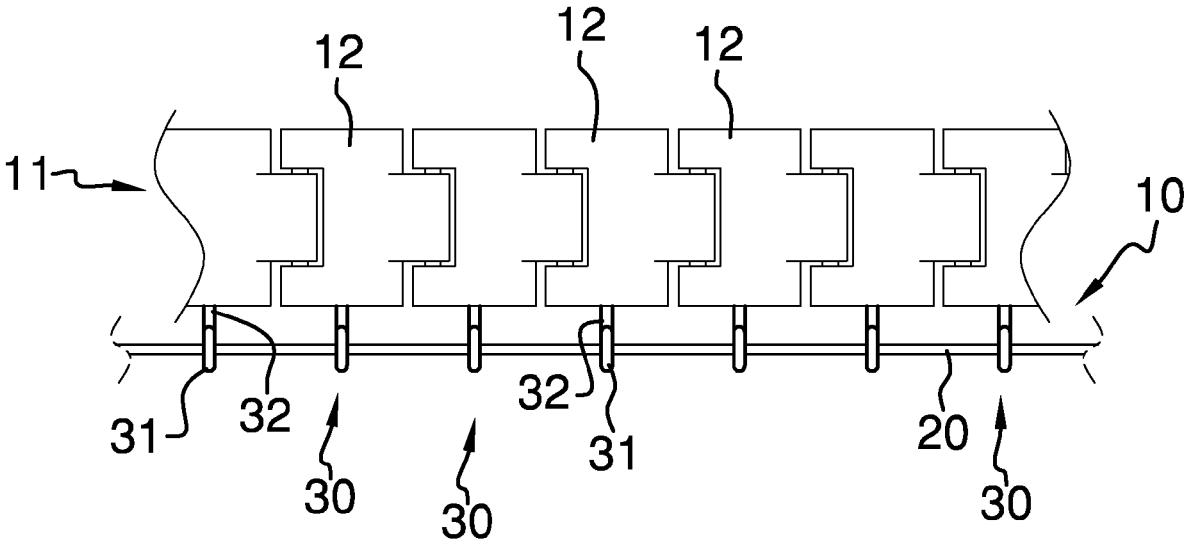
FIG. 4 is a partial top plan in-use view.

Referring to FIG. 4, the eye screws 30 are threadably attached to a link 12 of an existing multi-link band 11. Each link 12 has a right side 14 and a left side 15.

Figure 5:
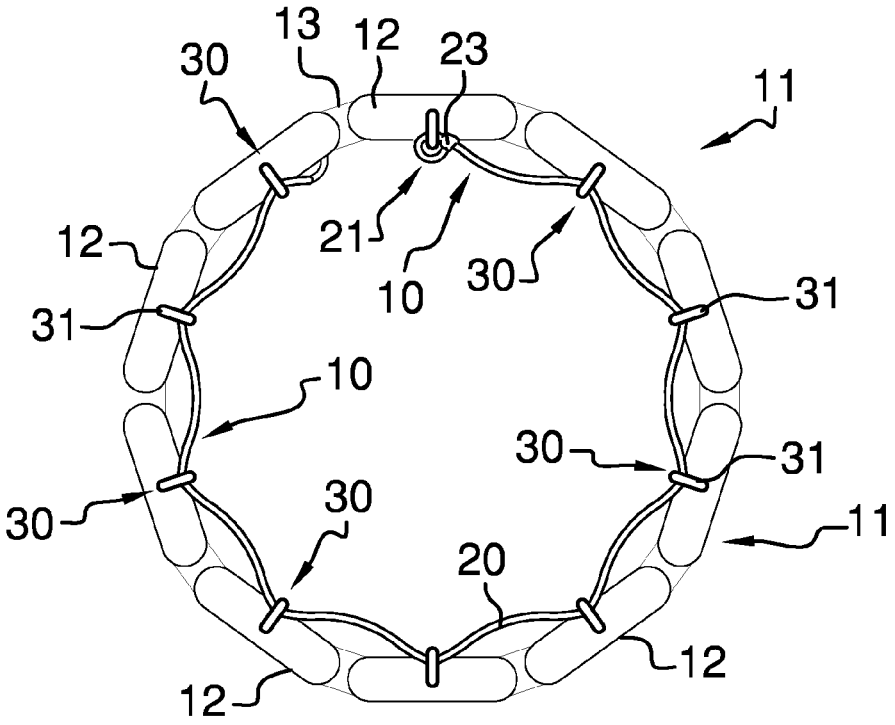
FIG. 5 is a top plan in-use view.
Figure 6:
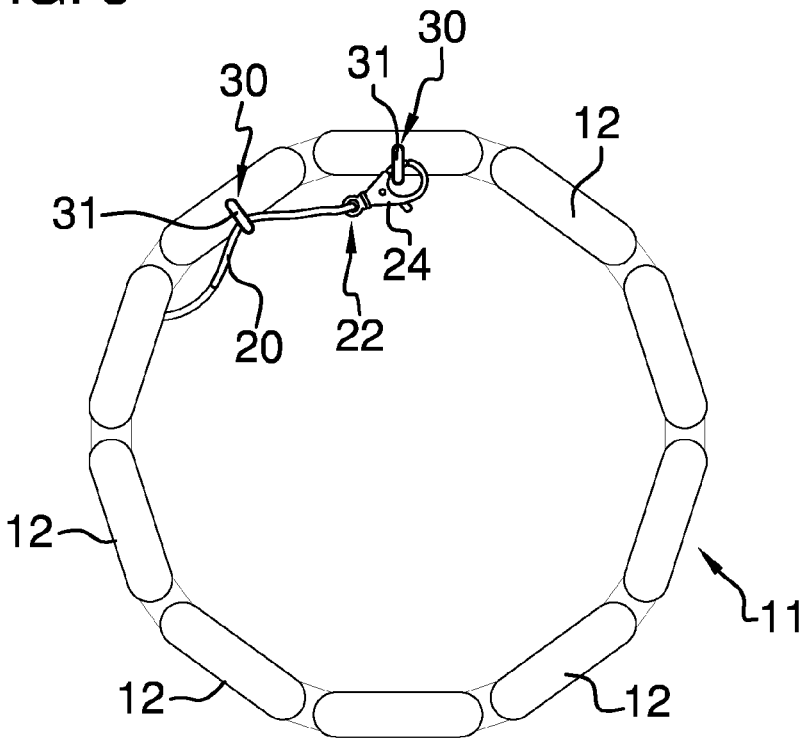
FIG. 6 is a bottom plan in-use view.

Referring to FIGS. 5 and 6, each link 12 has one eye screw 30 disposed on the left side 15 thereof. One of the eye screws 30 is disposed on the right side 14 of each link 12 disposed on each of a first outer end 16 and a second outer end 17 of the band 11. The flexible cable 20 and the loop 23 are configured to attach to the eyelet 31 of the eye screw 30 disposed on the left side of the link 12 disposed on the first outer end 16 of the multi-link band 11. The flexible cable 20 is configured to pass through a remainder of the eyelets 31 of each eye screw 30 on the left side 15 and of the eye screw 30 on the right side 14 of the link 12 disposed on the second outer end 17. The clasp 24 is configured to attach to one of the eyelets 31. The device 10 is used to connect the links 12 of the existing multi-link band 11 across the existing band clasp 13. The device 10 thereby removably secures a chosen pair of the links 12 together and prevents the multi-link band 11 from inadvertent disengagement, even if the existing band clasp 13 fails.

Directional terms such as "front", "back", "in", "out", "downward", "upper", "lower", and the like may have been used in the description. These terms are applicable cable to the embodiments shown and described in conjunction with the drawings. These terms are merely used for the purpose of description in connection with the drawings and do not necessarily apply to the position in which the jewelry safety chain device may be used.

What is claimed is:

1. A jewelry safety device comprising, in combination:

a band including a plurality of links, the plurality of links including a first end link disposed on a first end of the band, a second end link disposed on a second end of the band, and a plurality of intermediate links between the first end link and the second end link;

a flexible cable having a first end spaced apart from a second end;

a loop disposed on the flexible cable first end;

a clasp disposed on the flexible cable second end;

a plurality of eye screws, each eye screw comprising:

an eyelet;

a shaft extended from the eyelet;

a point disposed distally on the shaft;

a thread disposed on the shaft medially from the point;

wherein one of said plurality of eye screws is disposed on a first side of each link of the band;

wherein one of said plurality of eye screws is disposed on an opposite second side of the first end link of the band;

wherein one of said plurality of eye screws is disposed on an opposite second side of the second end link of the band;

wherein the loop of the flexible cable is attached to the eyelet of the eye screw disposed on the first side of the first end link of the band;

wherein the flexible cable passes through the remainder of eyelets of each eye screw on the first side of the links and through the eyelet of the eye screw positioned on the opposite second side of the second end link of the band; and wherein the clasp of the flexible cable is configured to attach to the eyelet of the eye screw disposed on the opposite second side of the first end link, thereby removably securing a chosen pair of links together.

2. The device according to claim 1 wherein the clasp further comprises a spring loaded clasp.

3. The device according to claim 2 further comprising various material makeups configured to be aesthetically matched to a given jewelry item.

4. The device according to claim 1 further comprising various material makeups configured to be aesthetically matched to a given jewelry item.

* * * * *